United States Patent [19]

Dykstra

[11] Patent Number: 4,599,055

[45] Date of Patent: Jul. 8, 1986

[54] PERISTALTIC PUMP

[75] Inventor: Raymond C. Dykstra, Boulder, Colo.

[73] Assignee: Cobe Laboratories, Inc., Lakewood, Colo.

[21] Appl. No.: 748,578

[22] Filed: Jun. 25, 1985

[51] Int. Cl.[4] ..... F04B 43/12

[52] U.S. Cl. ..... 417/477

[58] Field of Search ..... 417/477, 476, 475, 474

[56] References Cited

U.S. PATENT DOCUMENTS 3,963,023 6/1976 Hankinson ..... 128/214
4,231,725 11/1980 Hogan ..... 417/477
4,526,515 7/1985 DeVries ..... 417/475 X

FOREIGN PATENT DOCUMENTS 2028973 12/1970 Fed. Rep. of Germany ..... 417/477
2069063 8/1981 United Kingdom ..... 417/477

*Primary Examiner*—Richard E. Gluck

[57] ABSTRACT

A peristaltic pump comprising a base, a rotor rotatably mounted about a rotor axis and carrying rollers that travel in a circular path, a race with an internal surface for supporting a flexible tube being squeezed by the rollers traveling in the circular path, the race being pivotally mounted on the base to move between an operating position (adjacent to and concentric with the circular path) and a tube loading position (spaced from the circular path), and means to lock the race in the operating position.

3 Claims, 3 Drawing Figures

PERISTALTIC PUMP

FIELD OF THE INVENTION

The invention relates to peristaltic pumps.

BACKGROUND OF THE INVENTION

In peristaltic pumps, a flexible tube is squeezed between rollers that are carried by a rotor and travel along a circular path and a race with a circular surface adjacent to and concentric with the path of the rollers. As the occluded portion of the tube is advanced, the fluid in front of it is forced to travel through the tube.

SUMMARY OF THE INVENTION

I have discovered that the flexible tube of a peristaltic pump can be easily loaded by providing a pivotally mounted race that moves between an operating position adjacent to the circular path of the pump rollers and a tube loading position spaced from the circular path and by also providing means to lock the race in the operating position.

In preferred embodiments, there is a cover on the race that covers the rotor and the circular path of the rollers when the race is in the operating position; an electric switch senses when the race is locked into the operating position, and prevents the pump motor from operating when the race is not locked into the operating position; the locking mechanism includes a spring-biased pin carried by the race and a cam surface on the base leading to a depression; and the flexible tube is carried by a fluid flow chamber cassette that snaps into position on the base and accurately positions the tube relative to the circular path of the rollers.

Other advantages and features of the invention will be apparent from the following description of the preferred embodiment thereof and from the claims.

DESCRIPTION OF THE PREFERRED EMBODIMENT

The drawings will be briefly described first.

Drawings

Structure

Figure 1:
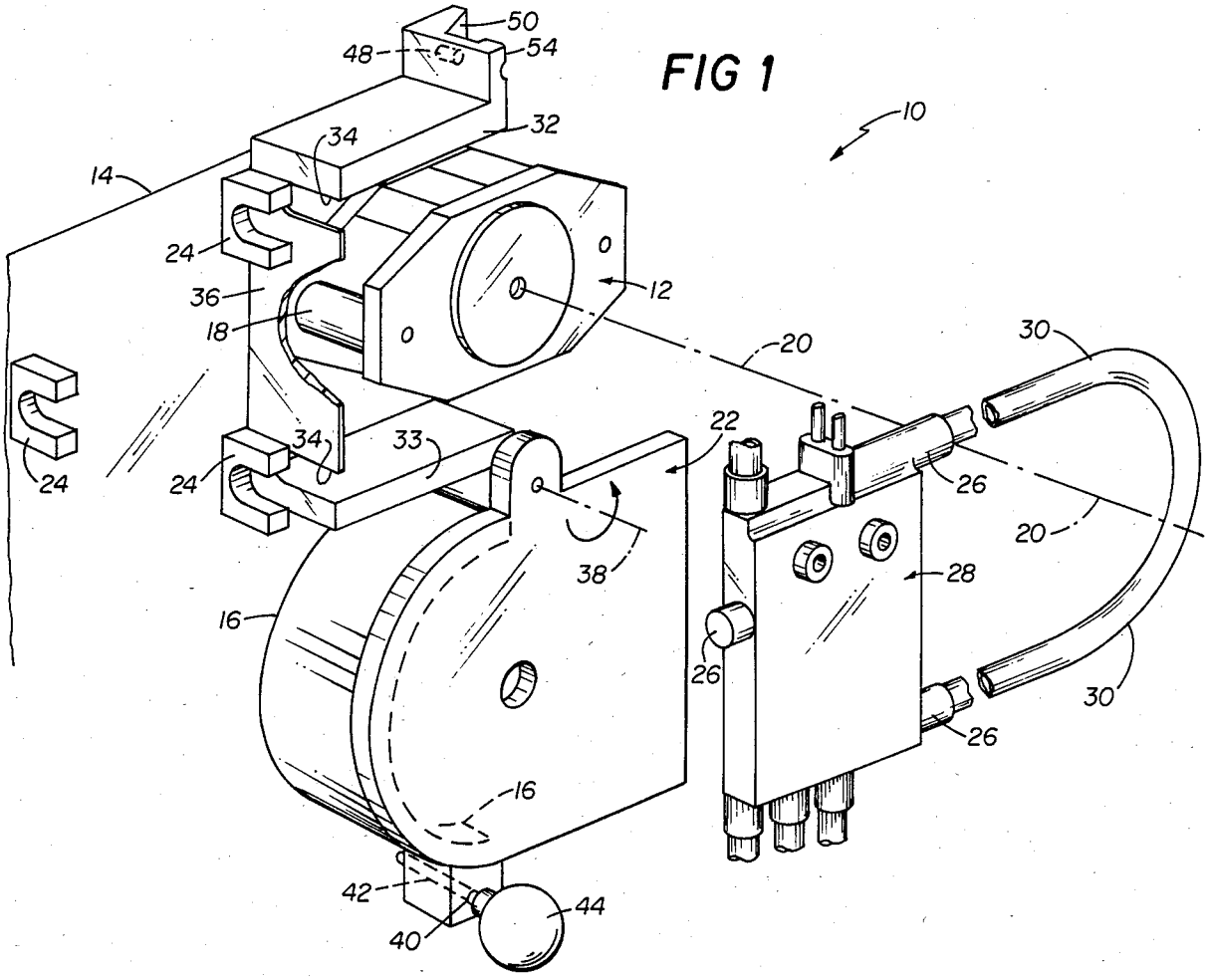
FIG. 1 is a diagrammatic perspective view of a peristaltic pump according to the invention in a loading position.
Figure 2:
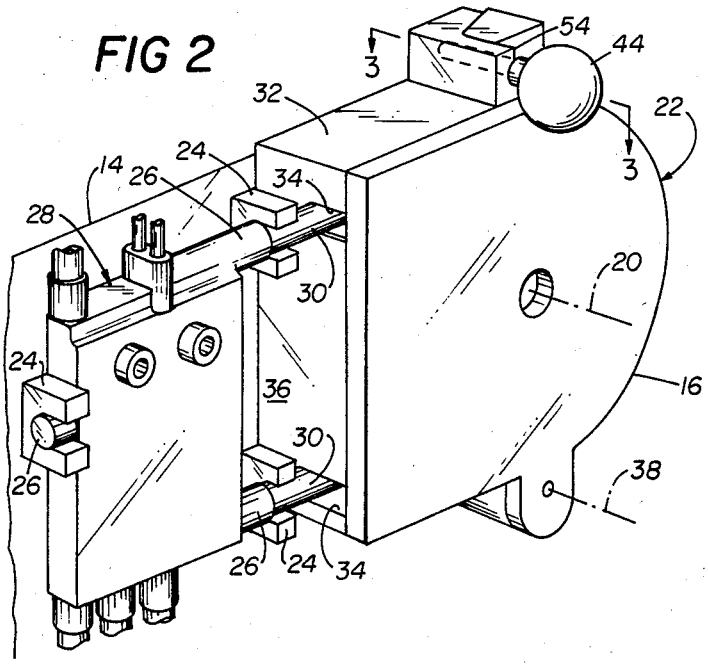
FIG. 2 is a perspective view of the FIG. 1 pump in an operating position.

Referring to FIGS. 1 and 2, there is shown peristaltic pump 10 including rotor 12 mounted for rotation on base 14 and pivotally mounted race 16. Rotor 12 carries rollers 18 which travel in a circular path about rotor axis 20. Secured to the top of race 16 is cover 22, which covers rotor 12 and the circular path of travel of rollers 18 when in the operating position shown in FIG. 2.

Base 14 includes clothespin-like clips 24 for engaging tubular projections 26 of fluid flow chamber cassette 28 having flexible tube loop 30 extending from one side of it. When cassette 28 is snapped into position on base 14, tube loop 30 fits within side guide walls 32, 33 of base 14 and around the end of rotor 12. As is shown in FIG. 2, tube loop 30 extends through grooves 34 of front plate 36 of base 14.

Race 16 is pivotally mounted about axis 38 through sidewall 33 of base 14 for rotation between the loading position of FIG. 1 and the operating position of FIG. 2. The inner surface of race 16 is circular (2.0" radius) for 180° about axis 20 when in the locked position and has tangential portions that extend from the circular portion ¾" at the end near wall 33, and 1 ¼" at the end near wall 32. The tangential portions are flush with the inner surfaces of guide walls 32, 33.

Figure 3:
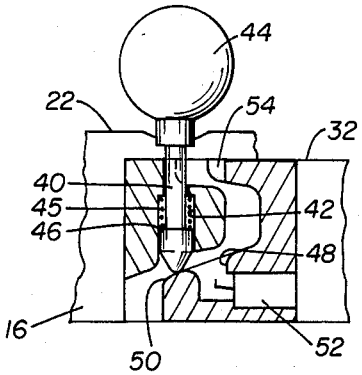
FIG. 3 is a partial vertical sectional view, showing mating pieces of a race and a base of the FIG. 1 pump prior to locking the race in an operating position.

Referring to FIG. 3, the locking mechanism for pump 10 is shown. It is seen that in the end of race 16 there is pin 40 slidably mounted within cylindrical hole 42. Attached to the top of pin 40 and extending above cover 22 is knob 44. Compression spring 45 is mounted on pin 40 in hole 42 and pushes against the top of hole 42 and annular surface 46 of pin 40. The bottom of pin 40 is designed to sit in depression 48 when race 16 is in an operating position. Camming surface 50 on base 14 leads to depression 48. Electric switch 52 is carried by base 14; it senses when the end of pin 40 is in depression 48, and is connected to provide a signal to the circuitry controlling the motor (not shown) for rotor 12.

Operation

In use, race 16 and its cover 22 are rotated to the loading position of FIG. 1, and cassette 28 is snapped into position on base 14 by causing projections 26 to be engaged by clips 24 and tube loop 30 to slide into grooves 34 of front plate 36, between guide walls 32 and around the end of rotor 12. During this loading operation, the motor is prevented from operating because switch 52 senses that the end of pin 40 is not within depression 48.

Race 16 is then rotated counterclockwise into the operating position shown in FIG. 2. As the end of race 16 approaches depression 48, the bottom of pin 40 is biased upward by cam surface 50, and the end of pin 40 drops into locked position in depression 48 (FIG. 3). The lower surface of race 16 is shaped to be guided by cam surface 50 as race 16 is locked into position, and the end of race 16 is firmly secured to base 14 when locked, owing to the mating shapes of the surfaces at the ends of race 16 and guide wall 32 and overhanging portion 54 at the end of guide wall 32. The tubing is thus very easily loaded in the peristaltic pump without the need for running the pump.

Once the race and cover are locked into position, rotor 12 is free to rotate upon commands from the machine (e.g., a dialysis preparation and supply machine). When in the position of FIG. 2, the circular surface of race 16 is adjacent to and concentric with the circular travel path of rollers 18. As rotor 12 rotates, rollers 18 squeeze portions of tube loop 30 against the inner surface of race 16. Tube loop 30 is fully occluded along the 180° circular surface of race 16. Because the flat tangential surfaces of race 16 extend from the circular surface of race 16 as part of an integral piece, the occluded portions of tube 30 are not forced against a junction between pieces that could cause abrasion of the tube with repeated use. Because cover 22 covers rotor 12 and the circular travel path of rollers 18, it prevents accidental injury to an operator from moving machine parts, as access to the rotating parts is prevented by cover 22 along with front wall 36 and side walls 32, 33. To unlock race 16, one merely pulls upward on knob 44.

Other Embodiments

Other embodiments of the invention are within the scope of the following claims.

What is claimed is:

1. A peristaltic pump comprising a base, a rotor rotatably mounted about a rotor axis and carrying rollers that travel in a circular path, a race with an internal surface for supporting a flexible tube being squeezed by said rollers traveling in said circular path, said race being pivotally mounted on said base to move between an operating position in which said surface is adjacent to and concentric with said circular path and a tube loading position in which said surface is spaced from said circular path, and means to lock said race in said operating position, said means to lock comprising a spring-biased pin carried by said race, and a cam surface leading to a depression on said base, said cam surface being positioned to cam said pin as said race is pivoted into said operating position, said pin being biased into said depression when in said operating position.

2. The peristaltic pump of claim 1, wherein said race has a surface that mates with said cam surface on said base when said race is in said operating position, and said base has a portion overhanging the end of said race when said race is in said operating position.

3. The combination of the peristaltic pump of claim 1 and a fluid flow chamber cassette carrying a U-shaped flexible tube on one side that is loaded into said pump when said race is in said loading position.

* * * * *